US006743336B1

(12) United States Patent
Rogelio

(10) Patent No.: US 6,743,336 B1
(45) Date of Patent: Jun. 1, 2004

(54) COMPOSITION FOR DE-ACIDIFICATION OF CELLULOSE MATERIAL

(75) Inventor: Areal Guerra Rogelio, Terrassa (ES)

(73) Assignee: Universitat Politecnica de Catalunya, Terrassa (ES)

( * ) Notice: Subject to any disclaimer, the term of this patent is extended or adjusted under 35 U.S.C. 154(b) by 0 days.

(21) Appl. No.: 09/744,655

(22) PCT Filed: Jul. 29, 1999

(86) PCT No.: PCT/ES99/00242

§ 371 (c)(1),
(2), (4) Date: Mar. 16, 2001

(87) PCT Pub. No.: WO00/08250

PCT Pub. Date: Feb. 17, 2000

(30) Foreign Application Priority Data

Jul. 31, 1998 (ES) ..... 9801737

(51) Int. Cl.[7] ..... D21H 17/72; D21H 25/18

(52) U.S. Cl. ..... 162/160; 162/183; 162/184; 252/380; 252/384; 422/40; 427/439

(58) Field of Search ..... 162/160, 181.4, 162/181.5, 77, 90, 72; 427/537, 538, 439, 537.5, 702; 422/40

(56) References Cited

FOREIGN PATENT DOCUMENTS

CA 2142195 A1 * 8/1996

* cited by examiner

*Primary Examiner*—Steve Alvo
(74) *Attorney, Agent, or Firm*—Notaro & Michalos P.C.

(57) ABSTRACT

The product is presented in the form of a solution and is composed of carbonated magnesium di-n-propylate, n-propanol, and a hydrofluorocarbon (HFC) diluent selected from 1,1,1,2-tetrafluoroethane (HFC 134a) and 1,1,1,2,3,3,3-heptafluoropropane (HFC 227). The product may be obtained by a procedure which comprises preparing a solution of carbonated magnesium di-n-propylate in n-propanol and diluting said solution by addition of the HFC diluent. The product is suitable for de-acidifying cellulose-type material and preserving objects based on cellulose-type material.

5 Claims, No Drawings

COMPOSITION FOR DE-ACIDIFICATION OF CELLULOSE MATERIAL

FIELD OF THE INVENTION

This invention relates to the preservation of objects that contain cellulose-type materials, in particular, to a product, in the form of a solution, for de-acidification of cellulose-type materials composed of carbonated magnesium di-n-propylate, n-propanol and a hydrofluorocarbon diluent.

BACKGROUND OF THE INVENTION

There is a lot of concern for the deterioration undergone by cellulose-type materials (books, documents, maps, press, magazines and tissues) held in libraries, newspaper archives, museums and archives. This deterioration endangers the physical integrity of many documents, books and tissues and thus forces a restriction in access and handling thereof. The most significant cause of deterioration in cellulose-type materials is hydrolysis catalyzed by acids in the cellulose, giving rise to a shortening of the polymeric chains of the cellulose, which, in turn, leads to a weakening of the cellulose fibers and they become more fragile. Many factors contribute to the acidification of cellulose-type materials. For example, acidic gases present in contaminated air, the use of alum and colophony (abietic acid) in paper production, products for oxidative degradation of cellulose, inks and other substances that oxidize cellulose which are present in paper and books.

A great deal of effort has been put in to the development of processes to achieve de-acidification of cellulose-type materials and thus to prolong their useful life by stopping acidic hydrolysis degradation processes. Specific compositions and products have been studied for de-acidification, capable of neutralizing the acid present in cellulose-type materials and introducing an alkaline reserve, which inhibits re-acidification. Technology has moved on from expensive craft methods using aqueous medium to the development of methods for applying alkaline reagents, dissolved in non-aqueous vehicles, either in liquid or solid state, to prevent books from falling apart.

The North American patent U.S. Pat. No. 3,676,182 (R. D. Smith, 11th Jul. 1972) relates to a procedure for non-aqueous de-acidification of paper using magnesium methoxide, dissolved in methanol to a concentration lying between 5% and 11%, as the de-acidifying agent. The resulting solution can be diluted with a chlorofluorocarbon (CFC) diluent, such as trichlorofluoromethane or dichlorodifluoromethane, until a liquid is formed, under pressure, that contains between 1% and 2% of the de-acidifying agent. The CFC compound quickly evaporates from paper impregnated with the de-acidifying solution containing methanol, thus minimizing the solvent effect of methanol on certain inks. The books and papers can be treated by immersion in the de-acidifying solution, or the solution can be applied with a brush or using a spray. Nevertheless, this method is not free from drawbacks as the magnesium methoxide is extremely sensitive to water. So much so that even traces of moisture lead to immediate hydrolysis forming a gelatinous precipitate of magnesium hydroxide. This is insoluble in water and many organic solvents. Unless the paper has been sufficiently desiccated before treatment premature hydrolysis of the magnesium methoxide may occur, leading to the formation of unwanted white marks of powdered magnesium hydroxide on the surface of the paper, giving the paper a rough feel. On the other hand, the spray nozzles frequently become blocked and the brush bristles become caked, making it necessary to clean them and then dry them thoroughly before using them again.

The North American Patent U.S. Pat. No. 3,939,091 (Kelly, G. B., 7th Feb. 1976) discloses and claims a product for the de-acidification of paper that overcomes the problems of previous de-acidification solutions based on magnesium methoxide dissolved in CFC. The magnesium methoxide dissolved in methanol or in a methanol and trichlorotrifluoroethane (Freon® F7) mixture is reacted with gaseous carbon dioxide to obtained a colourless 20% solution of methoxymagnesium methylcarbonate. The resulting solution is more tolerant of water than the magnesium methoxide solutions, and obstructions are not produced in the spray nozzles as often as before.

The Canadian patent CA 1.147.510 (Smith, R. D., 7th of Jun. 1983) discloses a method for the production of methoxymagnesium methylcarbonate. Metallic magnesium is allowed to completely react with methanol to form magnesium methoxide. This is then re-dissolved in methanol saturated with carbon dioxide forming a methoxymagnesium methycarbonate solution. This solution is diluted with trichlorotrifluoro-ethane or with dichlorodifluoromethane. The diluted solution is sprayed onto the paper to be de-acidified. As an alternative, the paper can be submerged in the same solution, with the liquid state being maintained under pressure.

The North American patent U.S. Pat. No. 4,860,685 (Smith, R. D., 29th of Aug. 1989) and the corresponding Canadian patent CA 1.272.018 (31st of Jul. 1990) describe a flexible spraying system for the de-acidification of cellulose-type materials. A de-acidifying agent, preferable an alkoxide of magnesium carbonate, is combined with a CFC diluent, preferably trichlorotrifluoroethane, and with a propellant gas, preferably dichlorodifluoromethane. Additional pressurization and propulsion can be achieved using an inert gas such as nitrogen. The carbonated magnesium alkoxide, such as methoxymagnesium methylcarbonate or ethoxymagnesium ethylcarbonate, is produced by dissolving the corresponding magnesium alkoxide in alcohol in the presence of carbon dioxide.

The procedures described above use CFCs as these are essentially non-reactive and so do not imply a direct toxic risk for living beings. However, these same properties of chemical inertness that the CFCs possess make them problematic in the stratosphere. It has been demonstrated that the CFCs are the main factor responsible for the destruction of the stratospheric ozone layer and that they contribute to the greenhouse effect in the troposphere. The problem revolves around the chlorine that is liberated when the CFCs are exposed to ultraviolet radiation and other more penetrating radiations in the stratosphere. The chlorine destroys ozone by catalysing its transformation into molecular oxygen. The production of CFCs has been banned since the $1^{st}$ of Jan. 1996 (Copenhagen Agreement which amends the Montreal Protocol of the $23–25^{th}$ of Nov. 1992), and use thereof should be totally eliminated before the year 2030.

The Canadian patent CA 2.142.195 (Worsford, D. James, 8th of Feb. 1995) discloses and claims a product for de-acidification of cellulose-type materials which consists of a de-acidifying reagent, such as methoxymagnesium methylcarbonate or ethoxymagnesium ethylcarbonate, a solvent such as methanol or ethanol, and a hydrochlorofluorocarbon diluent (HCFC) or hydrofluorocarbon (HFC). The product patented can be applied to the cellulose-type material by spray or with a brush, or by immersing the cellulose-type material in the product. As a novelty with respect to the patents cited earlier this patent describes the use of diluents that are not prohibited by the Montreal Protocol [HCFCs and HFCs].

The use of HCFCs and HFCs as a substitute for CFCs substantially reduces the number of chlorine radicals that can be liberated in the stratosphere on exposure to cosmic radiation, thus reducing the potential for ozone destruction. On the other hand, the presence of hydrogen means that the compound is more reactive, such that it tends to decompose more easily before reaching the stratosphere. The rate of decomposition of HCFCs and HFCs is higher than that of the CFCs, whose lifetime is quoted at being between 60 and 100 years.

The object of the present invention is to find a new product for the non-aqueous de-acidification of cellulose-type materials, thus providing an addition to the arsenal of means available for combating acidification of cellulose-type materials.

Therefore, an object of this invention consists of a product, in the form of a solution, for the non-aqueous de-acidification of cellulose-type materials which comprises carbonated magnesium di-n-propylate, n-propanol and an HFC diluent.

An additional object of this invention consists of a procedure for production of said product for the de-acidification of cellulose-type material.

Another additional object of this invention consists of a method for de-acidification of cellulose-type material which comprises use of the aforementioned product.

DETAILED DESCRIPTION OF THE INVENTION

The present invention provides a product for de-acidification of cellulose-type material, hereinafter denominated the product of the invention, characterized because it is presented in the form of a solution and is comprised of:

carbonated magnesium di-n-propylate, n-propanol, and an HFC diluent selected from 1,1,1,2-tetrafluoroethane (HFC 134a) y 1,1,1,2,3,3,3-heptafluoropropane (HFC 227).

Carbonated magnesium di-n-propylate is a white solid, with the formula $(CH_3CH_2CH_2O)_2$ MgOCO, soluble in anhydrous n-propanol and in medium-polarity solvents, such as HFC 227 and HFC 134a, whose polarities are 0.8 Debyes (D). The meaning of the term "organic solvents of medium polarity" in this description includes solvents with a dipole moment ($\mu$) less than water [:1.8 D], for example, toluene [:0.40 D] and n-propanol [:1.5 D]. Carbonated magnesium di-n-propylate has a dipole moment of 0.8 D and so, in general, it is soluble in any proportion in the HFC diluent used for producing the product of the invention. The dipole moment of this diluent is approximately 0.9 D. Carbonated magnesium di-n-propylate, on coming into contact with moist air, reacts to give magnesium/carbonate and magnesium hydroxide, and slowly releases n-propanol according to the reaction [1]:

$$2(CH_3CH_2CH_2O)_2MgOCO+3H_2O__Mg(OH)_2+MgCO_3+4CH_3CH_2CH_2OH \quad [1]$$

Carbonated magnesium di-n-propylate reacts vigorously with mineral acids releasing carbon dioxide and n-propanol, forming soluble magnesium salts as indicated by reaction [2]:

$$(CH_3CH_2CH_2O)_2MgOCO+2HCl__MgCl_2+CO_2+2CH_3CH_2CH_2OH \quad [2]$$

As a result of the high solubility of carbonated magnesium di-n-propylate in polar solvents, characterized by low surface tension and viscosity values, it can be dispersed deeply through the pores in the paper, reaching all points of cellulose-type material, and neutralizing the acids present. The excess reagent slowly decomposes into magnesium carbonate hydroxide, a stable compound of the formula $(MgCO_3)_4.Mg(OH)_2.5H_2O$, which it deposited among the paper fibres to act as a alkaline reservoir protecting against acidic atmospheric contaminants and acids released in the paper during ageing. The trials carried out on papers treated and submitted to accelerated ageing have shown that treatment with the product of the invention [see Example 3] stabilizes the properties of the mechanical resistance of the paper, manifesting itself as a stabilization in the degree of whiteness.

Carbonated magnesium di-n-propylate can be obtained from magnesium di-n-propylate by a procedure that comprises the stages of:

reacting a suspension of magnesium di-n-propylate in n-propanol with gaseous anhydrous carbon dioxide, until a solution of carbonated magnesium di-n-propylate is obtained; and separating said solution of carbonated magnesium di-n-propylate in n-propanol from the residual products, for example by decantation.

Reaction of magnesium di-n-propylate with anhydrous carbon dioxide is an exothermic reaction, reaching temperatures of up to 45° C. and the initial solid compound insoluble in n-propanol [magnesium di-n-propylate] is transformed into a soluble form consisting of carbonated magnesium di-n-propylate. The reaction is taken to have reached its conclusion when the temperature drops to room temperature. Next, the dark solid insoluble particles are allowed to sediment out on the bottom of the recipient and to give a clear and transparent solution. The resulting solution is collected by conventional techniques, for example, by decantation or, preferably, by suction under vacuum, and transferred to recipients suitable for loading, dilution or dosing. The carbonated magnesium di-n-propylate obtained is purified, for example, by evaporation of part of the solvent (typically 20–30%) under vacuum.

The concentration of carbonated magnesium di-n-propylate in the alcoholic solution lies between 30 and 70% (P/P), preferably between 45 and 50% (P/P) of carbonated magnesium di-n-propylate, the rest consisting of n-propanol. It can be adjusted to the desired concentration by conventional methods, for example, by dilution with n-propanol or by elimination of excess solvent.

Magnesium alkoxides can be obtained using known methods for example, *Metal Alkoxides*, by Bradley, D. C., Mehrotra, R. C. and Gaur, D. P., Academic Press, London (1978), and the work of Thoms, H., Epple, M., Viebrock, H. and Reller, A., *J. Mater. Chem.* 5(4)589, (1995), where the synthesis of different magnesium alkoxides from alcohols of up to four carbon atoms is described. Although various magnesium alkoxides are known, the literature only describes carbonated magnesium alkoxides derived from methanol (methoxymagnesium methylcarbonate) and ethanol (ethoxymagnesium ethylcarbonate) and the carbonate of methoxy and butoxy polyethylene glycol [WO 90/03466].

The suspension of magnesium di-n-propylate in n-propanol can be prepared by different procedures. One of them (Procedure A) comprises reacting magnesium metal with anhydrous n-propanol, in the presence of iodine, at the temperature corresponding to the boiling point of the mixture. Another procedure (Procedure B) comprises reacting magnesium metal with anhydrous n-propanol in the presence of iodine at reflux temperature and the addition of toluene to form an azeotrope with n-propanol. The magnesium metal used in either Procedure A or B may in the form of a strip, in which case, it requires a suitable preparation (see Example 1.2).

Alternatively, the suspension of magnesium di-n-propylate in n-propanol can be prepared by a procedure (Procedure C) which does not require the use of a strip of magnesium but rather magnesium in powder form, with a granulometric distribution between 50 and 150 m. This procedure C therefore comprises of; (i) reacting magnesium in powder form, with a granulometric distribution between 50 and 150 m, with anhydrous n-propanol in the presence of iodine, which acts as a catalyst. The mixture is gently heated until hydrogen begins to be released. From this moment on, as the reaction is strongly exothermic, the next step (ii) consists of cooling the reaction mixture to the temperature corresponding to the boiling point, with a view to controlling the reaction rate with gentle boiling until hydrogen is no longer given off and the last remaining particles of magnesium have disappeared. In this fashion a suspension of magnesium di-n-propylate in n-propanol is obtained.

The use of magnesium in the form of powder with the indicated granulometric distribution (50–150 m) means that the reaction of magnesium with n-propanol in the presence of iodine is exothermic, and so the reaction medium should be cooled instead of additional energy being provided. This also allows the reaction time to be reduced [typically, the total reaction time for production of magnesium di-n-propylate is 4–5 hours].

Carbonated magnesium di-n-propylate can be used in the production of a product, in the form of a solution, suitable for de-acidification of cellulose-type material along with n-propanol, and a diluent selected from HFC 134a and HFC 227.

The meaning of "cellulose-type material" as used in this description refers to a material totally or partially composed of cellulose fibres, including paper of all classes, tissues and fabrics which contain cellulose fibres of vegetal origin, for example, those produced from wood, cotton, flax, jute, hemp and other plants. Examples of such cellulose-type materials include books, documents, maps, works of art, articles elaborated with said materials, clothing, flags, etc.

For use as a reagent for de-acidification of cellulose-type material a solution of carbonated magnesium di-n-propylate and n-propanol is produced, in HFC diluent, at a concentration lying between 30% and 70% (W/V) for application by machine and of 3.5% to 4.5% (W/V) in said HFC diluent for application by sprays. In general, said solution is of light chestnut colour and viscous. To reduce as much as possible the unwanted effects of the alcohol on the components of the paper, it is useful to concentrate the resulting solution as much as possible while maintaining a suitable fluidity for dosing.

The concentrated solution of carbonated magnesium di-n-propylate is diluted to the desired concentration with a chemically inert and non-toxic diluent which allows the de-acidifying reagent to be carried inside the cellulose-type material. An HFC selected from HFC 134a and HFC 227 can be used as diluent. HFC 227 is preferable. HFC 227 has a boiling point of −17.3° C. at normal pressure (101.3 kPa), a liquid density of 1.417 g/cm$^3$ at 20° C. (399.3 kPa). The surface tensions are 9.31 mN/m (at 0° C.), 6.96 mN/m (at 20° C.) and 4.8 mN/m (at 40° C.) and its dipole moment is 0.2±0.14 D. HFC 227 has been marketed since 1991 as a substitute for R12 and R114 in sectors where these chemicals have been used as coolants. The company SOLVAY brought this product onto the market at the beginning of 1996 as, in September 1995, the European Commission for Pharmaceutical Products in Brussels (CPMP) established that HFC 227 was suitable for pharmaceutical inhalers.

Dilution of the concentrated solution of carbonated magnesium di-n-propylate is carried out with the chosen HFC, preferably HFC 227, in pressurized containers, up to de-acidification reagent concentrations [carbonated magnesium di-n-propylate] lying between 1% and 10% (W/V), preferably between 1% and 10% (W/V) and up to concentrations of n-propanol less than 10% (V/V). In a particular and preferred embodiment of the invention, the product of the invention contains between 3.8 and 4.5% (W/V) of carbonated magnesium di-n-propylate, between 2 and 3% (V/V) of n-propanol, the rest of the mixture consisting of the HFC diluent chosen from HFC 227 and HFC 134a, and the product of the invention of said formulation is especially suitable for use with spray systems.

Additionally and optionally, the product of the invention may contain an inert gas, for example, nitrogen, with a view to achieving additional pressure and propulsion.

The resulting diluted solutions of carbonated magnesium di-n-propylate may be applied by conventional methods, for example, by direct spray onto the cellulose-type material. This method of applying the de-acidification product does not require prior desiccation, under vacuum, of the cellulose-type material, as the distribution and impregnation attained using the spray is very uniform and does not lead to the accumulation of any type of deposit or residue on the cellulose-type material to be treated. In general, it is advisable to work in a fume cupboard and use means of personal protection to avoid inhaling the spray.

The product of de-acidification product of the cellulose-type material can also be carried out by means of dissolving in HFC to a known concentration, for the bulk de-acidification of books and documents, using the equipment and method described in the Spanish patent application P9600016 filed by the same applicant. The apparatus described is formed of a treatment chamber, which serves for the drying stages under vacuum prior to impregnation and recovery of solvent by evaporation-condensation.

Therefore, the invention also provides a method for de-acidification of cellulose-type material, which comprises the application, of a quantity sufficient of the product of the invention for de-acidifying the cellulose-type material to be treated. The product of the invention may be applied to the cellulose-type material to be treated by means of a bulk de-acidification system or by spray.

The product of the invention can be obtained through a procedure that comprises:

preparing a solution of carbonated magnesium di-n-propylate in n-propanol; and diluting said solution by addition of an HFC diluent selected from among HFC 134a and HFC 227.

In a particular embodiment, the concentration of carbonated magnesium di-n-propylate in said alcoholic solution lies between 30% and 70% (W/V).

Additionally and optionally, the product of the invention may contain an inert gas, for example, nitrogen.

The following examples serve as an illustration of the present invention and should not be considered as limiting the scope thereof.

EXAMPLE 1

Preparation of Carbonated Magnesium di-n-propylate

1.1 Dehydration of n-propanol

To dehydrate n-propanol a procedure such as the one described by A. I. Vogel, in "*Practical Organic Chemistry*", 3$^a$ Ed. Longmans, London, 1961, pag. 168, is used, duly modified for the case of n-propanol.

N-propanol (Panreac quality PS) is used with a water content of less than 0.1%. The residual water is almost completely eliminated following the procedure now described.

In a 2-liter round-bottomed flask 1.25 l of 1-propanol are placed and 7 g of clean metallic shiny sodium added. Once the sodium has completely reacted, 27 g of di-n-ethyl phthalate are added and the mixture boiled for 2 hours. Next, n-propanol is distilled over the temperature range 97–98° C., collecting it in a dry flask protected from external moisture with a tube containing anhydrous calcium chloride. This treatment allows almost complete elimination of water, given that the sodium hydroxide formed is consumed by hydrolysis of the phthalic ester, according to the following reactions:

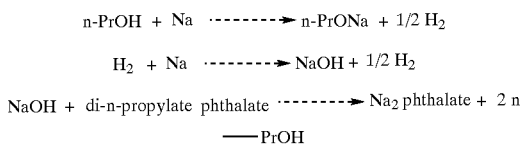

1.2 Preparation of the Magnesium Strip

To assure that the magnesium metal reacts well the surface layer of oxides, carbonates, etc., which has formed on coming into contact with the atmosphere, should be removed. To achieve this, about 200 g of magnesium strip are treated with 0.5 l of dilute hydrochloric acid (approximately 5% concentration) for a short time, normally 5 minutes, shaking in an open Erlenmeyer flask so that the hydrogen is eliminated. Then it is quickly washed with distilled water several times until the acid is completely eliminated. This elimination can be verified by means of conventional methods for quantifying the presence of chloride ions. The next step is to eliminate the water with successive washes, usually 2 or 3 washes, with absolute ethanol, before drying between filter papers and storing in a topaz flask under a nitrogen atmosphere. The strip is then dried in an oven at 100° C. for 15 minutes, allowed to cool, always under dry nitrogen atmosphere, and the container hermetically sealed.

1.3 Preparation of Magnesium di-n-propylate (Procedure A)

In a 5-liter round-bottomed flask 3.750 ml of anhydrous n-propanol are placed (3 kg, 50 mols) prepared according to the procedure described in Example 1.1. Next, 146 g (6 mols) of magnesium metal are added in the form of a strip prepared according to the procedure described in Example 1.2 along with 3 g of iodine as catalyst. Next, the reaction mixture is heated to boiling for 6 hours, thus obtaining a suspension of magnesium di-n-propylate, a grey-coloured grey-white coloured crystalline solid in n-propanol. The resulting suspension is allowed to cool before proceeding to the next step in the reaction. A quantity of product of between 770 and 800 g is obtained, with yields of between 90 and 92%. The concentration of magnesium di-n-propylate in said suspension lies between 34 and 35% by weight.

1.4 Preparation of Magnesium di-n-propylate (Procedure B)

To 1,250 ml of anhydrous n-propanol (1 kg, 50 mols) prepared according to the procedure described in Example 1.1, 48.8 g (2 moles) of magnesium metal in the form of a strip prepared according to the procedure described in Example 1.2 are added, along with 1 g of iodine as a catalyst. Next, the reaction mixture is boiled under reflux for 16 hours, and 350–390 ml of toluene are added to the product thus obtained to eliminate part of the n-propanol and to suitably concentrate the solution to achieve product concentrations of between 45 and 50% by weight. The toluene is used to provide an azeotropic mixture with a lower boiling point to eliminate the n-propanol. The composition of the azeotrope is 48% propanol and 52% toluene and the boiling point (b.p.) of the azeotrope is 92° C. [b.p. of propanol: 97.2° C., and b.p. of toluene: 110.6° C.].

Operating in this way, adding 390 ml of toluene leads to the elimination of 350 ml of n-propanol by the composition of the azeotrope. Thus a solid impregnated with n-propanol is obtained, with a small amount of toluene (less than 1%) which for yields of the order of 90% gives a concentration of the order of 50% of magnesium di-n-propylate.

1.5 Preparation of Carbonated Magnesium di-n-propylate

A current of carbon dioxide, completely anhydrous after passing through drying towers filled with anhydrite, is passed through a suspension of magnesium di-n-propylate in n-propanol obtained in Example 1.3 or in Example 1.4. Prior to this, said suspension of magnesium di-n-propylate in n-propanol has been cooled as the reaction with carbon dioxide is exothermic and goes more slowly and with slight decomposition of the products if carried out at temperatures greater than 50° C. The solid starting product [magnesium di-n-propylate] is transformed into a soluble form consisting of carbonated magnesium di-n-propylate, by raising the temperature to 45–50° C. The reaction is over after 5–6 hours, and this is manifest by a drop in the temperature of the reaction mixture to room temperature. Next, the dark insoluble solid particles are allowed to sediment out until they deposit on the bottom of the flask leaving a clear and transparent solution, over a time period of 48.72 hours and the solution of carbonated magnesium di-n-propylate is collected and transferred by suction under vacuum to the recipient for loading and dosing.

The amount of carbonated magnesium di-n-propylate obtained from 6 mols of magnesium is 912 g in approximately 1,700 g of n-propanol, giving rise to a concentration in the carbonated product of the order of 54% by weight.

The carbonated magnesium di-n-propylate is purified by total evaporation of n-propanol under vacuum, and; (i) its magnesium content is analysed by complexometric titration, and (ii) its bound carbon dioxide content analysed through decomposition of a sample with concentrated phosphoric acid, and collection of $CO_2$ in a series of towers containing a known excess of barium hydroxide. The following results were obtained:

Theoretical $CO_2$: 23.62% $CO_2$ found: 23.43%

Theoretical Mg: 13.04% Mg found: 12.92%

The infrared spectrum of the product [carbonated magnesium di-n-propylate] shows a medium-narrow band at 536 $cm^{-1}$ corresponding to the Mg—O bond, and an intense band at 1,652 $cm^{-1}$ corresponding to the C═O bond of the carbonate.

The molar ratio $Mg/CO_2$ is close to 1:1, thus the formula of carbonated magnesium di-n-propylate is $CH_3CH2CH_2OMgOCOOCH_2CH_2CH_3$ [$MgC_7H_{14}O_4$, molecular weight: 186].

The solubility of carbonated magnesium di-n-propylate in HFC 227 reaches values lying between 1 g % up to 200 g %.

Thus it can be affirmed that the product is soluble at any proportion. The carbonated magnesium di-n-propylate is soluble in HFC 134a in analogue proportions.

EXAMPLE 2

Preparation of Carbonated Magnesium di-n-propylate

2.1 Preparation of Magnesium di-n-propylate (Procedure C)

In a 5-liter round-bottomed flask, 3.750 ml of anhydrous n-propanol are placed (3 kg, 50 mols), prepared according to the procedure described in Example 1.1. Next, 146 g (6 mols) of magnesium metal are added in the form of a powder with a granulometric distribution lying between 50 and 100 m, along with 7.5 g of iodine as a catalyst. Next the mixture is heated gently until hydrogen begins to be given off, and from then on, as the reaction is strongly exothermic, the reaction medium is cooled with a view to controlling the rate of reaction at a gentle boiling for six hours until hydrogen is not longer released and the last particles of magnesium have disappeared. A suspension of magnesium di-n-propylate, a light grey-coloured solid, is obtained in n-propanol. The mixture is allowed to cool before proceeding to the next step in the reaction. 770–800 g of product are obtained, with yields between 90–92%.

2.2 Preparation of Carbonated Magnesium di-n-propylate

A current of carbon dioxide, completely anhydrous after passing through two drying towers full of anhydrite, is passed through the suspension of magnesium di-n-propylate in n-propanol. The reaction is exorthermic, reaching temperatures of 45° C. The solid starting product [magnesium di-n-propylate] is transformed into a soluble form consisting of carbonated magnesium di-n-propylate. The reaction is over after 4–6 hours. When the temperature drops to room temperature the product is allowed to sediment out for 24–48 hours until the solid dark insoluble particles are lying at the bottom of the flask, and the solution appears clear and transparent. This solution may be collected by decantation or even better transferred by suction under vacuum, to recipients appropriate for loading, dilution or dosing. The magnesium content in this solution, measured by complexometric titration, is greater than 5%, which represents 40% as carbonated magnesium di-n-propylate.

The product is purified by total evaporation of n-propanol under vacuum, and the Mg content analysed by complexometric titration, and the $CO_2$ content is determined by decomposition of a sample with concentrated phosphoric acid and collection of $CO_2$ in a series of towers containing a known excess of barium hydroxide. The results obtained coincide with these mentioned in Example 1.5.

EXAMPLE 3

Efficacy Assays

In order to check the efficacy of a product for the de-acidification of the cellulose-type material provided by the invention some assays have been carried out to determine the absorption of said product on a cellulose-type material to assay, along with some assays to determine the mechanical characteristics of the cellulose-type material treated.

Parallel to this, by way of comparison, a commercial paper de-acidification product [Bookkeeper] of high efficiency has been assayed and the results compared in each case.

3.1 Absorption Assays

The absorption of the product for de-acidification constitutes an indication of the alkaline reserve created in the cellulose-type material. This reservoir may play an important role in combating the degradation of cellulose by acid hydrolysis and, therefore, is going to contribute to the better preservation of the cellulose material.

In the assays carried out to check the efficacy of the product provided by the invention the cellulose-type material used was paper in different stages of ageing (without ageing and submitted to accelerated ageing).

Briefly, the assay carried out consisted of applying the product for de-acidifying the paper to the sheets of paper, either to one side or to both sides, and then determining the alkaline reserve created in the paper. Assays have been affected in different conditions of ageing of the paper. The results obtained are shown in Tables 1–3.

3.1.A. Without Ageing

The results obtained at zero time, in other words, without submitting the paper to an accelerated ageing process are shown in Table 1.

TABLE 1

Efficacy assay (Without ageing of the paper)

| Sample | Initial weight (g) | Dry weight (g) | Humidity (%) | HCl | NaOH | Alkaline reserve (mol/kg) |
|---|---|---|---|---|---|---|
| Bookkeeper 1 side | 1.017 | 0.948 | 6.78 | 2.565 | 2.39 | 0.184 |
| Bookkeeper 2 sides | 1.006 | 0.923 | 8.18 | 2.565 | 2.25 | 0.341 |
| Invention 1 side | 1.012 | 0.910 | 10.9 | 2.565 | 2.01 | 0.609 |
| Invention 2 sides | 1.006 | 0.905 | 10.1 | 2.565 | 1.5 | 1.176 |

Bookkeeper: Commercial product comprising micronised magnesium oxide, a humectant and a freon.
Invention: Solution of carbonated magnesium di-n-propylate and n-propanol in an HFC diluent selected from HFC 134a and HFC 227, at 4%.
HCl: No. of HCl equivalents.
NaOH: No. of NaOH equivalents.

As can be seen, the alkaline reserve created by the product of the invention is very much better (a little greater than three times better) than that created using Bookkeeper.

3.1.B. Accelerated Ageing (5 Years)

Additional assays were carried out submitting the paper to an accelerated ageing process, consisting of keeping the paper in a chamber at a temperature of 90° C. and a relative humidity of 50%. Under these conditions, 1 hour of treatment of the paper is equivalent to an ageing of 7.5 days. Next, the product is applied to the aged paper with the cellulose-type material to be de-acidified. In Table 2 the results obtained after submitting the paper to a 10-day treatment are shown. This period corresponds to an ageing of the paper of 5 years.

TABLE 2

Efficacy assay (Accelerated ageing of the paper: 5 years)

| Sample | Initial weight (g) | Dry weight (g) | Humidity (%) | HCl | NaOH | Alkaline reserve (mol/kg) |
|---|---|---|---|---|---|---|
| Bookkeeper 1 side | 1.015 | 0.962 | 5.57 | 2.565 | 2.40 | 0.171 |

TABLE 2-continued

Efficacy assay (Accelerated ageing of the paper: 5 years)

| Sample | Initial weight (g) | Dry weight (g) | Humidity (%) | HCl | NaOH | Alkaline reserve (mol/kg) |
|---|---|---|---|---|---|---|
| Bookkeeper 2 sides | 1.011 | 0.964 | 4.27 | 2.565 | 2.23 | 0.347 |
| Invention 1 side | 1.017 | 0.961 | 5.54 | 2.565 | 1.98 | 0.608 |
| Invention 2 sides | 1.021 | 0.964 | 5.56 | 2.565 | 1.73 | 0.866 |

Bookkeeper: Commercial product comprising micronised magnesium oxide, a humectant and a freon.
Invention: Solution of carbonated magnesium di-n-propylate and n-propanol in an HFC diluent selected from HFC 134a and HFC 227, at 4%.
HCl: No. of HCl equivalents.
NaOH: No. of NaOH equivalents.

Just as with the previous case, the alkaline reserve created by the product of the invention is very much better (between 2.5 and 3.5 times better) than that created using Bookkeeper.

3.1.C. Accelerated Ageing (10 Years)

Other assays were carried out submitting the paper to the treatment for accelerated ageing as mentioned above [keeping the chamber at a temperature of 90° C. and the relative humidity at 50%] for a period of 20 days, which represents an ageing of the paper of 10 years. Next, the product is applied to the aged paper with the cellulose-type material to be de-acidified. The results obtained are shown in Table 3.

TABLE 3

Efficacy assay (Accelerated ageing of the paper: 10 years)

| Sample | Initial weight (g) | Dry weight (g) | Humidity (%) | HCl | NaOH | Alkaline reserve (mol/kg) |
|---|---|---|---|---|---|---|
| Bookkeeper 1 side | 1.023 | 0.984 | 3.75 | 2.565 | 2.39 | 0.177 |
| Bookkeeper 2 sides | 1.028 | 0.977 | 4.95 | 2.565 | 2.32 | 0.250 |
| Invention 1 side | 1.022 | 0.972 | 4.84 | 2.565 | 1.83 | 0.756 |
| Invention 2 sides | 1.032 | 0.987 | 4.33 | 2.565 | 1.64 | 0.925 |

Bookkeeper: Commercial product comprising micronised magnesium oxide, a humectant and a freon.
Invention: Solution of carbonated magnesium di-n-propylate and n-propanol in an HFC diluent selected from HFC 134a and HFC 227, at 4%.
HCl: No. of HCl equivalents.
NaOH: No. of NaOH equivalents.

Just as with the previous cases, but in an even more noticeable fashion, the alkaline reserve created by the product of the invention is very much better (between 3.7 and 4.2 times approximately) than that created using Bookkeeper.

3.2 Assay of Mechanical Properties

Through use of conventional methods (based on the corresponding ASTM, ISO and TAPPI technical guidelines) the tearing load, the stretching, the elastic limit, the length of tear and the pH of the sheets of paper treated, in one case with the product for de-acidification of cellulose-type materials provided by this invention [Invention], and in the other case with Bookkeeper. The results obtained are shown in Table 4 where each value indicated represents the mean from 7 measurements. The pH is calculated with a mean of 5 values taken from different areas of the sheet of paper.

TABLE 4

Mechanical properties

| [1] | [2] | [3] | [4] | [5] | [6] | [7] | [8] | [9] |
|---|---|---|---|---|---|---|---|---|
| Bookkeeper 1 side, 0 days | 0.184 | 55.8 (4.2) | 3.64 (0.26) | 16.8 (3.5) | 0.84 (0.08) | 4802 (360) | 54.3 (6.9) | 8.3 |
| Bookkeeper 1 side 10 days | 0.171 | 55.4 (5.3) | 2.30 (0.28) | 17.4 (3.6) | 0.81 (0.09) | 4738 (456) | 30.6 (7.8) | 7.4 |
| Bookkeeper 1 side 20 days | 0.177 | 46.8 (5.3) | 1.98 (0.28) | 16.1 (8.2) | 0.74 (0.32) | 4070 (462) | 19.9 (5.9) | 8.2 |
| Bookkeeper 2 sides 0 days | 0.341 | 54.5 (3.2) | 3.69 (0.23) | 14.3 (4.1) | 0.80 (0.12) | 4627 (272) | 53.9 (5.9) | 8.5 |
| Bookkeeper 2 sides 10 days | 0.347 | 49.4 (3.8) | 2.17 (0.25) | 16.8 (2.9) | 0.80 (0.06) | 4268 (329) | 24.O (6.2) | 7.8 |
| Bookkeeper 2 sides 20 days | 0.250 | 52.1 (3.0) | 2.22 (0.24) | 17.4 (6.2) | 0.82 (0.12) | 4417 (225) | 26.1 (5.3) | 8.0 |
| Invention 1 side 0 day | 0.609 | 56.3 (4.7) | 3.54 (0.25) | 15.9 (4.7) | 0.81 (0.12) | 4791 (396) | 53.6 (8.8) | 9.3 |
| Invention 1 side 10 days | 0.608 | 56.5 (8.8) | 2.22 (0.45) | 19.4 (5.3) | 0.84 (0.11) | 4736 (742) | 29.3 (13) | 8.0 |
| Invention 1 side 20 days | 0.756 | 60.3 (2.9) | 2.58 (0.18) | 20.1 (4.7) | 0.85 (0.08) | 5020 (242) | 37.4 (6.0) | 8.7 |
| Invention 2 sides 0 days | 1.176 | 65.1 (2.1) | 3.42 (0.08) | 18.0 (3.6) | 0.81 (0.13) | 5316 (171) | 58.6 (3.0) | 10.2 |
| Invention 2 sides 10 days | 0.866 | 59.6 (4.1) | 2.23 (0.29) | 16.2 (4.5) | 0.75 (0.08) | 4879 (333) | 30.1 (7.3) | 8.4 |
| Invention 2 sides 20 days | 0.925 | 54.5 (4.4) | 2.38 (0.36) | 21.4 (2.5) | 0.89 (0.06) | 4596 (373) | 30.7 (8.6) | 9.1 |

Key:
[1]: Sample
[2]: Alkaline reserve (mol/kg)
[3]: Tearing load (N)
[4]: Stretching (mm)
[5]: Elastic limit (N)
[6]: Extension of elastic limit (mm)
[7]: Length of tear (m)
[8]: Traction energy absorption [T.E.A.] (J)
[9]: pH
Invention: Solution of carbonated magnesium di-n-propylate and n-propanol in an HFC diluent selected from HFC 134a and HFC 227, at 4%.
Bookkeeper: Commercial product comprising micronised magnesium oxide, a humectant and a freon.
The values in brackets indicate standard deviations.

The results highlight the better behaviour of the product of the invention compared to Bookkeeper.

What is claimed is:

1. A chemical composition for the de-acidification of a porous cellulose material, the composition being in the form of a solution and comprising:

carbonated magnesium di-n-propylate;

n-propanol; and a hydrofluorocarbon selected from the group consisting of 1,1,1,2-tetrafluoroethane and 1,1,1,2,3,3,3-heptafluoropropane.

2. A chemical composition according to claim 1, including 30% to 70% (W/V) of the carbonated magnesium di-n-propylate in n-propanol.

3. A chemical composition according to claim 1, wherein the concentration of carbonated magnesium di-n-propylate in the solution formed in n-propanol and a diluent is between 1% and 10% (W/V).

4. A chemical composition according to claim 1, wherein the concentration of n-propanol in the solution is between 2% and 3% (V/V).

5. A chemical composition according to claim 1, wherein the concentration of carbonated magnesium di-n-propylate in the solution is between 3.8% and 4.5% (W/V) and the concentration of n-propanol in the solution is between 2% and 3% (V/V).

* * * * *

UNITED STATES PATENT AND TRADEMARK OFFICE

CERTIFICATE OF CORRECTION

PATENT NO. : 6,743,336 B1
APPLICATION NO. : 09/744655
DATED : June 1, 2004
INVENTOR(S) : Areal Guerra Rogelio It is certified that error appears in the above-identified patent and that said Letters Patent is hereby corrected as shown below:

Column 3, line 43, change "[:1.8 D]" to --[μ:1.8 D]--.

Column 3, line 44, change "[:0.40 D] and n-propanol [:1.5 D]" to --[μ:0.40 D] and n-propanol [μ:1.5 D]--.

Column 5, line 5, change "50 to 150 m" to --50 and 150 μm--.

Column 5, line 8, change "50 to 150 m" to --50 and 150 μm--.

Column 5, line 18, change "(50-150 m)" to --(50-150 μm)--.

Column 9, lines 15 to 16, change "50 and 100 m" to --50 and 100 μm--.

Signed and Sealed this

Twenty-third Day of September, 2008

JON W. DUDAS
*Director of the United States Patent and Trademark Office*